US008118421B2

(12) United States Patent
Badesha et al.

(10) Patent No.: US 8,118,421 B2
(45) Date of Patent: Feb. 21, 2012

(54) PRESSURE AND TRANSFIX ROLLERS FOR A SOLID INK JET PRINTING APPARATUS

(75) Inventors: Santokh S. Badesha, Pittsford, NY (US); Paul John McConville, Webster, NY (US); James Edward Williams, Penfield, NY (US); Kock-Yee Law, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 680 days.

(21) Appl. No.: 12/277,402

(22) Filed: Nov. 25, 2008

(65) Prior Publication Data

US 2009/0160920 A1 Jun. 25, 2009

Related U.S. Application Data

(63) Continuation-in-part of application No. 11/961,600, filed on Dec. 20, 2007.

(51) Int. Cl.
*B41J 2/01* (2006.01)

(52) U.S. Cl. ..... 347/103

(58) Field of Classification Search ..... 347/88, 347/99, 101, 103; 101/217
See application file for complete search history.

(56) References Cited

U.S. PATENT DOCUMENTS 4,179,601 A 12/1979 Tarumi et al.
5,420,679 A * 5/1995 Goto et al. ..... 399/335
5,724,638 A * 3/1998 Isogai et al. ..... 399/333
5,765,085 A 6/1998 Law et al.
5,925,893 A 7/1999 Ishii et al.
6,037,092 A 3/2000 Heeks et al.
6,137,986 A * 10/2000 Sugino et al. ..... 399/333
6,365,280 B1 4/2002 Schlueter, Jr. et al.
6,424,815 B1 * 7/2002 Kawamoto et al. ..... 399/325
6,813,470 B1 11/2004 Elbert et al.
6,829,466 B2 12/2004 Finn et al.
6,970,672 B2 11/2005 MacMillan et al.
7,322,689 B2 1/2008 Kohne et al.
7,325,917 B2 2/2008 Kohne et al.
7,407,278 B2 8/2008 Kohne et al.
2002/0064402 A1 5/2002 Badesha et al.
2006/0034645 A1 2/2006 Lee et al.
2007/0003329 A1 1/2007 Kim
2007/0154240 A1 7/2007 Elbert et al.

* cited by examiner

*Primary Examiner* — Anh T. N. Vo
(74) *Attorney, Agent, or Firm* — Maginot, Moore & Beck, LLP

(57) ABSTRACT

A printing machine for transferring a phase change ink onto a print medium includes a component for applying a phase change ink in an image, an imaging member for accepting the image and transferring the image from the imaging member to the print medium and a pressure member positioned in association with the imaging member to form a nip through which the print medium passes. The pressure member includes an outer layer with a tailored electrical conductivity to eliminate ghosting in duplex printing modes. The outer layer comprises a composite of a polymer and carbon nanotubes and/or graphenes. A similar outer layer may be implemented on a pressure roller in a direct-to-paper printing machine.

9 Claims, 5 Drawing Sheets

PRESSURE AND TRANSFIX ROLLERS FOR A SOLID INK JET PRINTING APPARATUS

CROSS-REFERENCE TO RELATED APPLICATION

This application is a continuation-in-part to commonly-owned co-pending application Ser. No. 11/961,600, filed on Dec. 20, 2007, entitled "Electrically Resistive Coatings/Layers Using Soluble Carbon Nanotube Complexes In Polymers," the disclosure of which is incorporated herein by reference.

FIELD

The present disclosure concerns imaging or printing machines, particularly to of the solid-ink jet type, and more specifically to pressure and transfix rollers used in such machines.

BACKGROUND

Herein are described printing machines, and more specifically phase change ink apparatuses, with particular attention to pressure and transfix rollers for use in direct and offset printing or ink jet printing apparatuses. In certain embodiments, a single layer transfix pressure member can be used in high speed printing machines and can be used in combination with phase change inks such as solid inks.

Ink jet type phase change printing systems using intermediate transfer, transfix or transfuse members are well known, such as that described in U.S. Pat. No. 4,538,156. Generally, a printing or imaging member is employed in combination with a printhead. A final receiving surface or print medium is brought into contact with the imaging surface after the image has been placed thereon by the nozzles of the printhead. The image is then transferred and fixed to a final receiving surface by the imaging member in combination with a transfix pressure member, or in other embodiments, by a separate fuser and pressure member.

More specifically, one type of phase-change ink imaging process begins by first applying a thin liquid, such as, for example, silicone oil, to an imaging member surface. The solid or hot melt ink is placed into a heated reservoir where it is maintained in a liquid state. Once within the printhead, the liquid ink is ejected, typically through use of a piezoelectric transducer. Several rows of jets, for example four rows, can be used, each one with a different color. The individual droplets of ink are jetted onto the liquid layer on the imaging member. The imaging member and liquid layer are held at a specified temperature such that the ink hardens to a ductile visco-elastic state.

After depositing the image, a print medium is heated by feeding it through a preheater and into a nip formed between the imaging member and a pressure member, either or both of which may be heated. In certain apparatuses, a high durometer synthetic transfix pressure member is placed against the imaging member in order to develop a high-pressure nip. As the imaging member rotates, the heated print medium is pulled through the nip and is pressed against the deposited ink image with the help of a transfix pressure member, thereby transferring the ink to the print medium. The transfix pressure member compresses the print medium and ink together, spreads the ink droplets, and fuses the ink droplets to the print medium. Heat from the preheated print medium heats the ink in the nip, making the ink sufficiently soft and tacky to adhere to the print medium. When the print medium leaves the nip, stripper fingers or other like members, peel it from the printer member and direct it into a media exit path. On the other hand, in a typical direct printing system, ink is ejected from jets in the print head directly onto the final receiving web or substrate such as paper or cut paper.

To optimize image resolution, the transferred ink drops should spread out to cover a predetermined area, but not so much that image resolution is compromised or lost. The ink drops should not melt during the transfer process. To optimize printed image durability, the ink drops should be pressed into the paper with sufficient pressure to prevent their inadvertent removal by abrasion. Finally, image transfer conditions should be such that nearly all the ink drops are transferred from the imaging member to the print medium.

The imaging member is multi-functional. First, the ink jet printhead prints images on the imaging member, and thus, acts as an imaging member. Second, after the images are printed on the imaging member, they can then be transfixed or transfused to a final print medium. Therefore, certain imaging members can provide a transfix function in addition to an imaging function. More specifically, a single drum surface transfers the image, spreads the ink droplets, penetrates the ink into the media, and controls the topography of the ink to increase paper gloss and transparency haze.

The process requires a delicate balance of drum temperature, paper temperature, transfix load, and drum and transfix roller materials and properties in order to achieve acceptable image quality. These combined requirements reduce the drum material possibilities mainly due to wear of weaker materials, which result in gloss and haze degradation. For most applications, a certain amount of gloss on a print is desired, but for some applications it is desirable to obtain either a very fine matte finish or a gloss finish.

In order to ensure proper transfer and fusing of the ink off the imaging member to the print medium, certain nip temperature, pressure and compliance are required. Unlike laser printer imaging technology in which solid fills are produced by sheets of toner, the solid ink is placed on the imaging member one pixel at a time and the individual pixels must be spread out during the transfix process to achieve a uniform solid fill. Also, in color printing machines the secondary color pixels on the imaging member are physically taller than the primary color pixels because the secondary pixels are produced from two primary pixels. Therefore, compliance in the nip is required to conform around the secondary pixels and to allow the primary pixel neighbors to touch the media with enough pressure to spread and transfer. A correct amount of temperature, pressure and compliance is required to produce acceptable image quality.

Currently, a typical transfix pressure roller for certain commercial products which produce up to 24 images per minute, comprises a substrate, a polyether-based polyurethane or a nitrile-butadiene rubber (NBR) intermediate layer having a modulus from about 40 to 120 MPa, and having a thickness of from about 1.0 to about 10.0 mm, and an outer layer comprising a polyester-based polyurethane or a nitrile butadiene rubber (NBR), having a modulus from 5 to 40 MPa, and a thickness of from about 0.1 to about 3.0 mm. Certain single layer transfix pressure rollers that produce up to 6 prints per minute comprise a substrate of a millable gum polyether-based polyurethane material having a modulus of about 70 MPa and a thickness of 2.6 mm.

The transfix pressure exerted at the nip in many prior machines is from about 500 to about 700 psi. However, more recent transfix pressure members must allow for exertion at the nip of from about 750 to about 4,000 psi for use in high-pressure, high-speed machines. Therefore, as the process speed goes up for high-speed machines, the size of the roller and the required pressure increases to enable high speed printing with desired image quality to achieve the same image quality. As the pressure requirement is increased, the design of the transfix pressure member requires that the layers on the member become thinner and harder for a given applied load on the member. As the layers become thinner and harder, the ability to keep uniform pressure across the nip, while maintaining the necessary nip profile for paper handling, becomes more and more difficult. In addition, the member sees reasonably high temperature variations, print liquids, and ink components, which could adversely affect its function and print quality.

In many solid ink jet and direct-to-paper applications, over and above the complex issues just described, duplex printing quality has been challenging. One problem is known as "ghosting" in which gloss patterns are created when the first printed side of the substrate contacts the pressure roller during duplex operation. When the previously applied ink comes into contact with the pressure roll, some of the oil that is in or on the ink from the initial spreading step transfers onto the pressure roller in the pattern of the first image. When this oil pattern on the pressure roller then comes in contact with the ink on the subsequent transfix step gloss patterns can be created.

One solution to this problem is related to the oil levels on the transfix and pressure rollers. In some solid ink jet processes, the transfix roller is oiled via contact with the imaging drum. In direct to paper systems there is no contact with the drum, so in some printing machines an oil maintenance unit is provided that applies oil directly to the pressure roll. This latter solution to direct printing systems adds cost and complexity.

What is needed is a pressure and transfix roller design that solves the problem of ghosting during duplex printing, particularly for solid ink or phase change printing machines, and for direct-to-paper printing machines. The roller design should also address oil level issues in both offset and direct printing applications.

SUMMARY

As disclosed herein, these needs are addressed by a printing machine for transferring a phase change ink onto a print medium comprising: a phase change ink component for applying a phase change ink in a phase change ink image; an imaging member for accepting the phase change ink image from the phase change ink component, and transferring the phase change ink image from the imaging member to the print medium; and a transfix pressure member positioned in association with the imaging member, wherein the print medium passes through a nip formed between the imaging member and the transfix pressure member. The imaging member exerts pressure on the transfix pressure member so as to transfer and fuse the phase change ink image from the imaging member to the print medium. The transfix pressure member includes an outer layer with tailored electrical properties to eliminate ghosting in a duplex mode of operation. The outer layer of the transfix member comprises a composite of a polymer and solublized carbon nanotubes.

Also contemplated is a transfix pressure member positioned for use in a printing machine in association with an imaging member, in which the transfix pressure member comprises an inner substrate and an outer layer disposed on the inner substrate, in which the outer layer comprises a composite of a polymer and solublized carbon nanotubes.

The layers of a transfix member (or pressure member in a direct-to-paper printing machine) include an outer layer having sufficient strength to withstand the extreme environment of the transfix member. It is contemplated that the electrically conductive composite constitutes the outer layer and is not a surface coating on the layer. Thus, the electrically conductive properties are embedded or incorporated directly into at least the outer layer of the transfix member, without the need to provide any additional layer or surface coating.

More specifically, the outer layer, whether in a single or multiple layer transfix roller, incorporates solubilized carbon nanotubes and/or graphenes that provide the tailored electrical properties without sacrificing the ability of the layer to withstand the working environment of the roller. The electrically conductive composite thus preferably has a modulus of at least 1 MPa and preferably in the range of 8-330 MPa for a single layer roller and 1-50 MPa for a multiple layer roller.

DETAILED DESCRIPTION

Herein is described an printing apparatus useful with phase-change inks such as solid inks, and comprising a coated transfix pressure member, which aids in the transfer and fixing of a developed ink image to a copy substrate. In embodiments, the transfix pressure member is useful in high speed, high pressure printing applications.

Figure 1:
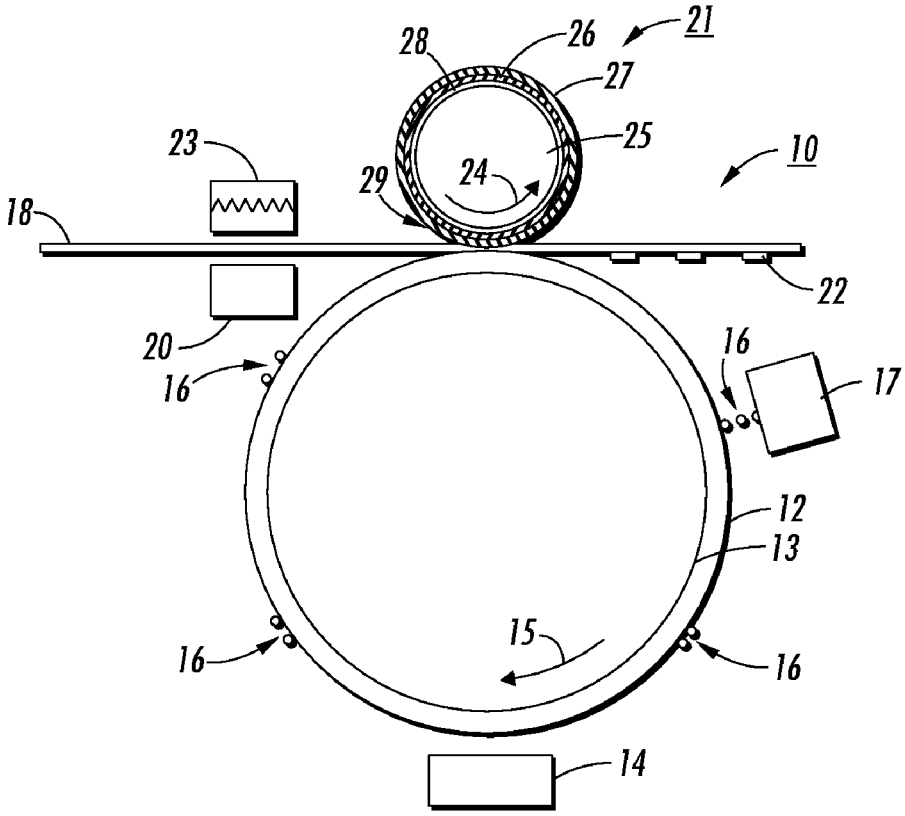
FIG. 1 is a side schematic representation of printing machine capable of implementing the roller features disclosed herein.

Referring to FIG. 1, a representation of an offset printing apparatus 10 is shown that functions to transfer an ink image from an imaging member 13 to a final printing medium or receiving substrate 18. As the imaging member 13 turns in the direction of arrow 15, a liquid surface 12 is deposited thereon. The imaging member 13 is depicted in this embodiment as a drum member, although it should be understood that other embodiments can be used, such as a belt member, film member, sheet member, or the like. The liquid layer 12 is deposited by an applicator 14 that may be positioned at any location relative to the drum, as long as the applicator 14 has the ability to make contact and apply the liquid surface 12 to the imaging member 13.

The ink used in the printing process can be a phase change ink, such as, for example, a solid ink. The term "phase change ink" means that the ink can change phases, such as a solid ink becoming liquid ink or changing from a solid into a more malleable state. Specifically, in certain embodiments, the ink can be in solid form initially and then can be changed to a molten state by the application of heat. The solid ink may be solid at room temperature, or at about 25° C. and possess the ability to melt at temperatures from about 65° C. to about 150° C. The high temperature melted ink 16 is ejected from a printhead 17 onto the liquid layer 12 previously deposited on the imaging member 13. In this example, the ink is then cooled to an intermediate temperature of from about 20° C. to about 80° C., and solidifies into a malleable state in which it can then be transferred onto the final receiving substrate or print medium 18. Some of the liquid layer 12 is transferred to the print medium 18 along with the ink. A typical thickness of transferred liquid is about 10 to about 100 nanometer.

Suitable liquids that may be used as the print liquid surface 12 include water, fluorinated oils, glycol, surfactants, mineral oil, silicone oil, functional oils, and the like, and mixtures thereof. Functional liquids include silicone oils or polydimethylsiloxane oils having mercapto, fluoro, hydride, hydroxy, and the like functionality.

Feed guide(s) 20 and 23 help to feed the print medium 18, such as paper, transparency or the like, into the nip 29 formed between the transfix pressure member 21 (shown as a roller) and the imaging member 13. It should be understood that the pressure member can be in the form of a belt, film, sheet, or other form. In certain embodiments, the print medium 18 is heated prior to entering the nip 29 by heated feed guide 23. When the print medium 18 is passed between the imaging member 13 and the transfix pressure member 21, the melted ink 16 now in a malleable state is transferred from the imaging member 13 onto the print medium 18 in image configuration. The final ink image 22 is spread, flattened, adhered, and fused or fixed to the final print medium 18 as the print medium moves between nips 29. In a typical application, the nip width is from about 2.0 to about 6.0 mm. In an alternative embodiment, a separate optional fusing station may be located downstream of the feed guides.

The pressure exerted at the nip 29 may range from about 750 to about 4,000 psi. Therefore, the transfix pressure member 21 must be configured to survive this pressure over millions of cycles before replacement is necessary.

Figure 2:
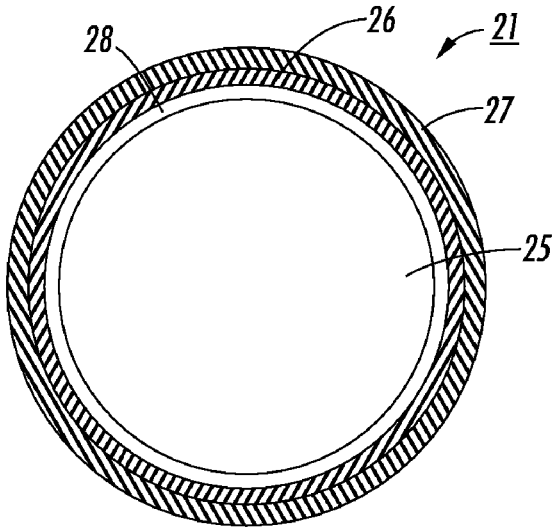
FIG. 2 is a cross-sectional end view of a pressure or transfix roller of a multiple layer design that is capable of implementing the features disclosed herein.

An enlarged view of a typical transfix pressure member 21 is shown in FIG. 2. The member includes an inner substrate 25 and outer layer 27 positioned on the substrate 15. In some embodiments, an outer liquid layer (not shown) is deposited on the outer layer 27. In some machines, an intermediate layer 26 may be positioned between the substrate 25 and outer layer 27. In other machines, an underlayer 28 may be positioned on the substrate, with the intermediate layer positioned on the underlayer and the outer layer 27 positioned on the intermediate layer.

In typical machines, the outer layer 27 is formed of a urethane material, such as a polyurethane material. Examples of suitable polyurethanes include polyester-based polyurethanes. The material can have a modulus from about 8 to about 300 MPa and a thickness of about 0.3 to about 10 mm for a single layer embodiment. In multi-layer embodiments, the intermediate layer may be comprised of a similar material with a modulus of from about 50 to about 300 MPa, and a thickness ranging from about 0.5 to about 10 mm. In the two-layer embodiment, the modulus of the outer layer may be modified to from about 1 to about 50 MPa, while the thickness may be changed to from about 0.1 to about 2 mm. In embodiments utilizing an underlayer 28, that layer may have a modulus from about 1 to about 100 MPa, and a thickness from about 0.5 to about 6 mm, with appropriate modifications to the thickness of the intermediate and outer layers.

In prior machines it has been known to incorporate certain fillers into the substrate, intermediate layer(s), and/or outer layer. These fillers typically have the ability to increase the material hardness or modulus into a desired range. Examples of known fillers include metals, metal oxides, doped metal oxides, carbon, ceramics, silicates (such as zirconium silicate, mica and the like), polymers, and the like, and mixtures thereof. Examples of carbon fillers include carbon black (such as N-990 thermal black, N330 and N110 carbon blacks, and the like), graphite, fluorinated carbon (such as ACCUFLUOR® or CARBOFLUOR®) and the like, and mixtures thereof. Examples of polymer fillers include polytetrafluoroethylene powder, polypyrrole, polyacrylonitrile (for example, pyrolyzed polyacrylonitrile), polyaniline, polythiophenes, and the like, and mixtures thereof.

The transfix pressure substrate can comprise any material having suitable strength for use as an imaging member substrate. Examples of suitable materials for the substrate include metals, fiberglass composites, rubbers, and fabrics. Examples of metals include steel such as stainless steel, carbon steel and the like, aluminum such as anodized aluminum and the like, nickel, and their alloys, and like metals, and alloys of like metals. The thickness of the substrate can be set appropriate to the type of imaging member employed.

In machines in which the transfix pressure member includes an intermediate layer, that layer must be configured so that it does not delaminate from the core during transfer of at least 1,000,000 copy substrates under normal use conditions. Likewise, the outer layer must also be configured to avoid delamination under similar use conditions.

As explained above, one concern that arises in solid ink jet (SIJ) transfer machines or apparatuses is the problem of ghosting in the duplex printing mode of operation. It has been found that ghosting is directly related to the amount of contact charging of the transfix roller, for instance, upon the first passage of the printing sheet. The inventors herein have discovered that introducing electrical conductivity to the outer layer 27 can significantly reduce and even eliminate unwanted ghosting by providing an electrical path for dissipating the contact charge that would otherwise accumulate on the surface of the roller. It has also been found that altering the contact charging properties of the roller will lead to lower charge generation during use. The present disclosure thus contemplates introducing electrical conductivity to the roller in lieu of the ancillary oiling approach of prior systems.

Figure 3A:
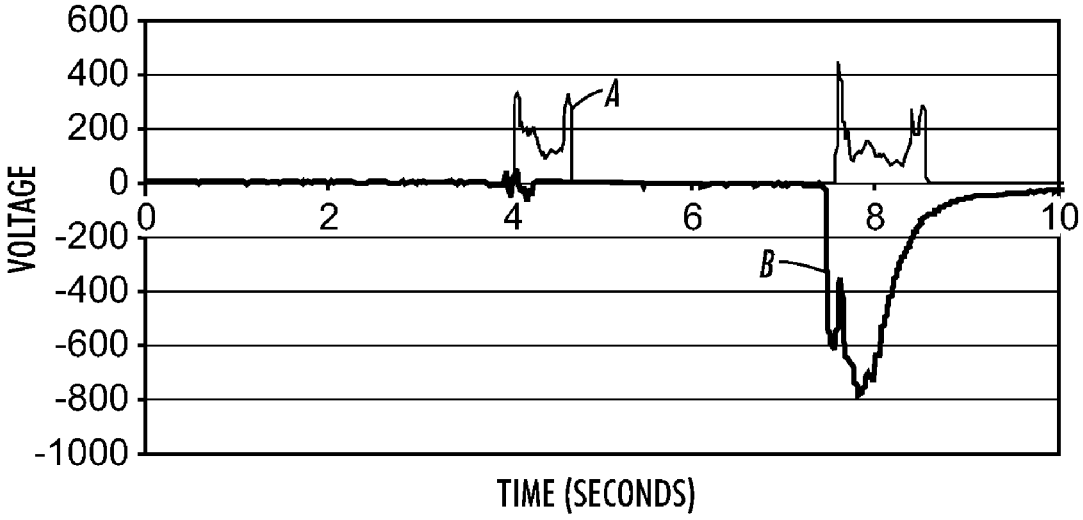
FIG. 3 is a graph showing the surface potential over time on the surface of a transfix roller during a duplex printing operation.
Figure 3B:
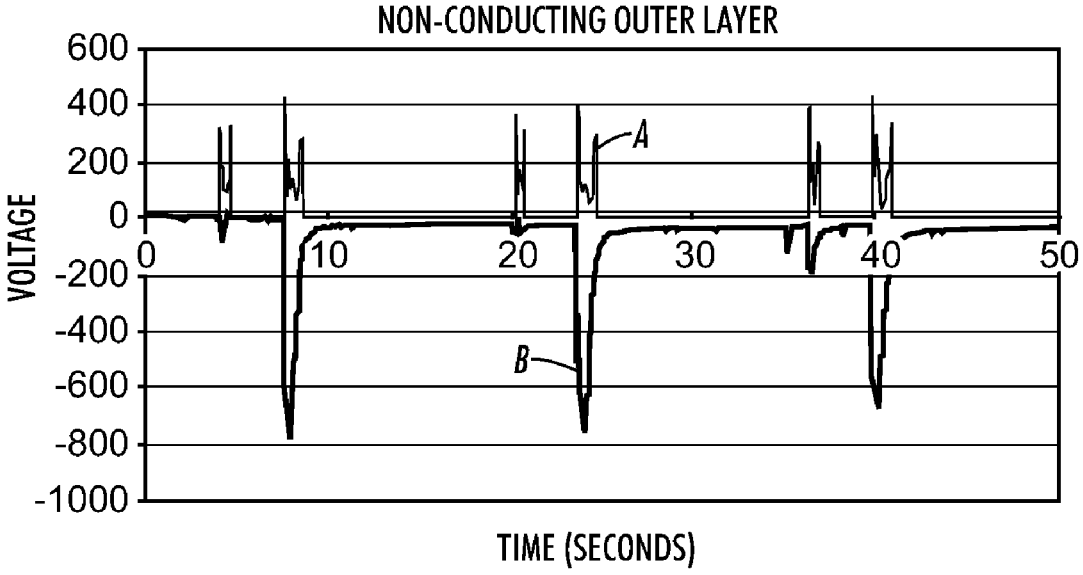

By way of example, the graph of FIG. 3 shows the surface potential on a transfix roller of an SIJ machine during a duplex printing operation. The first voltage spikes correspond to printing the first side of the sheet, while the later set of voltage spikes occur during the printing of the second side. The upper curve A corresponds to the potential across the sheet onto which the image is being transferred, while the lower curve B corresponds to the voltage potential on the surface of the transfix roller. As revealed in the graph of FIG. 3 the surface charge increases significantly at the duplex printing operation.

Figure 4:
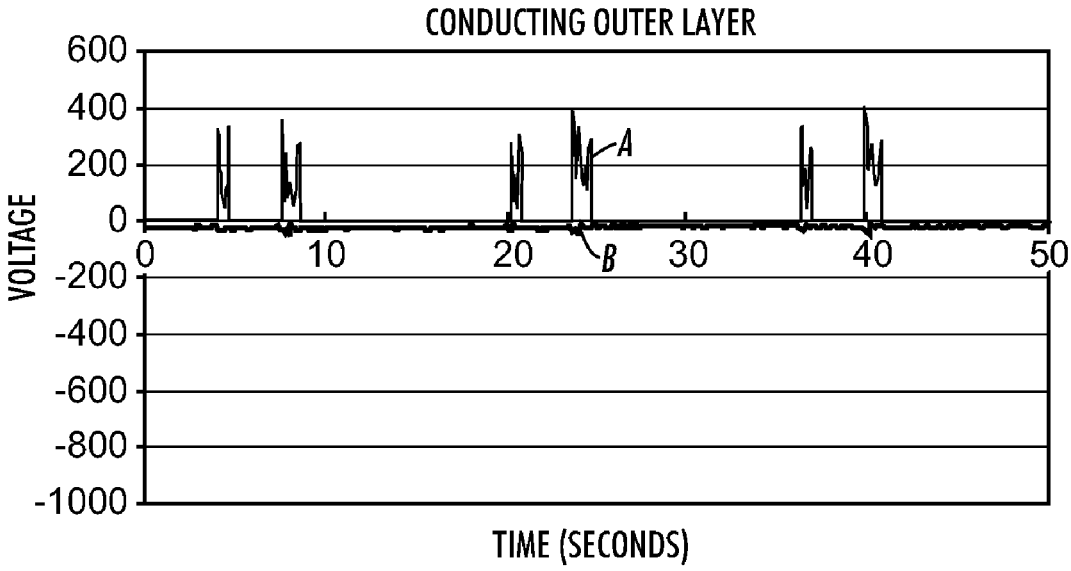
FIG. 4 is a graphical comparison of the conductivity performance between a typical non-conductive transfix roller and a conductive roller according to the present disclosure over three duplex print cycles.

The two graphs in FIG. 4 show a comparison of the conductivity performance between a typical non-conductive transfix roller and a conductive roller according to the present disclosure over three duplex print cycles. In the first graph the roller surface generates a significant voltage spike during each of the second/duplex prints. However, in the lower graph, the roller comprising the conductive layer according to the present disclosure exhibits only minimal surface charge generation in spite of the voltage spikes occurring in the printing sheet.

It is thus contemplated that the outer layer 27 of the transfix roller in an SIJ apparatus comprise a composite material that provides tailored electrical or conductive properties. It is important that these tailored electrical properties not come at a cost to the mechanical strength of the roller. It is thus further contemplated that the composite material not sacrifice mechanical strength and preferably even increase the strength and durability of the roller surface.

In furtherance of these objectives it has been found that a transfix roller surface formed of a composite of a polymer and carbon nanotubes not only provides a stronger and more durable roller construction, it also permits tailoring of the electrical conductivity of the roller surface. In a specific embodiment, the composite forming the outer layer 27 incorporates a dispersion of carbon nanotubes sufficient to produce a resistivity in the range of 1 to $10^6$ ohm-cm across the length of the roller at the nip 29, and contact charging properties of less than 100V surface potential. The modulus of the resulting composite preferably ranges from 5 to 40 MPa. In a preferred embodiment, the carbon nanotubes are provided in the range of 1-10% by weight of the composite.

Carbon nanotubes (CNTs) typically have a tubular shape of one-dimensional nature which can be grown through a nano metal particle catalyst. More specifically, carbon nanotubes can be synthesized by arc discharge or laser ablation of graphite. In addition, CNTs can be grown by a chemical vapor deposition (CVD) technique. With the CVD technique, there are also variations including plasma enhanced and so forth.

Carbon nanotubes can also be formed with a frame synthesis technique similar to that used to form fumed silica. In this technique, carbon atoms are first nucleated on the surface of the nano metal particles. Once supersaturation of carbon is reached, a tube of carbon will grow.

Regardless of the form of synthesis, the diameter of the tube will be comparable to the size of the nanoparticle. Depending on the method of synthesis, reaction condition, the metal nanoparticles, temperature and many other parameters, the carbon nanotube can have just one wall, characterized as a single-walled carbon nanotube. A single-walled CNT is essentially composed of a single graphite layer or graphene that is closed cylindrically. Alternatively, a multi-walled carbon nanotube is one having a shape in which a plurality of graphenes are layered telescopically such that the respective graphenes are closed cylindrically to form a coaxial multilayered structure. The central portions of the cylindrical graphenes are hollow. The distal end portions of the graphenes may be closed, or broken and accordingly open. The purity, chirality, length, defect rate, etc. can be varying. Very often, after the carbon nanotube synthesis, there can occur a mixture of tubes with a distribution of all of the above, some long, some short.

Single wall carbon nanotubes can be about 1 nm in diameter whereas multi-wall carbon nanotubes can measure several tens nm in diameter, but both are far thinner than their predecessors, which are called carbon fibers. For purposes of the present disclosure, it will be appreciated that the carbon nanotube is hollow, consisting of a "wrapped" graphene sheet. In contrast, while the carbon nano fiber is small, and can even be made in dimension comparable to some large carbon nanotubes, it is a solid structure rather than hollow.

Carbon nanotubes in the present disclosure can include ones that are not exactly shaped like a tube, such as: a carbon nanohorn (a horn-shaped carbon nanotube whose diameter continuously increases from one end toward the other end) which is a variant of a single-wall carbon nanotube; a carbon nanocoil (a coil-shaped carbon nanotube forming a spiral when viewed in entirety); a carbon nanobead (a spherical bead made of amorphous carbon or the like with its center pierced by a tube); a cup-stacked nanotube; and a carbon nanotube with its outer periphery covered with a carbon nanohorn or amorphous carbon.

Furthermore, carbon nanotubes in the present disclosure can include ones that contain some substances inside, such as: a metal-containing nanotube which is a carbon nanotube containing metal or the like; and a peapod nanotube which is a carbon nanotube containing a fullerene or a metal-containing fullerene.

As described above, in the present disclosure, it is possible to employ carbon nanotubes of any form, including common carbon nanotubes, variants of the common carbon nanotubes, and carbon nanotubes with various modifications, without a problem in terms of reactivity. Therefore, the concept of "carbon nanotube" in the present invention encompasses all of the above, including graphenes themselves.

One of the characteristics of carbon nanotubes resides in that the aspect ratio of length to diameter is very large since the length of carbon nanotubes is on the order of micrometers. Depending upon the chirality, carbon nanotubes can be metallic and semiconducting.

Carbon nanotubes excel not only in electrical characteristics but also in mechanical characteristics. That is, the carbon nanotubes are distinctively tough, as attested by their Young's moduli exceeding 1 TPa, which belies their extreme lightness resulting from being formed solely of carbon atoms. In addition, the carbon nanotubes have high elasticity and resiliency resulting from their cage structure. Having such various and excellent characteristics, it has been determined that carbon nanotubes are well-suited for use in the pressure and transfix rollers of an imaging or printing machine.

The physical properties of carbon nanotubes that provide their inherent strength also cause nanotubes to bundle. This property (van der Walls attraction) thus presents a significant challenge to good dispersion of the nanotubes through a composite base material. Carbon nanotubes have been considered insoluble in a solvent and applications of CNTs had been limited to those materials using carbon nanotube dispersion. In a typical preparation of a filled polymer coating, mixing and blending are used to prepare a dispersion and then a coating. Even when carbon nanotubes are blended with polymers, the dispersion can be unsuitable depending upon the process. It has proven difficult to prepare reliable relaxable CNT materials using the usual dispersion techniques, particularly for dispersions that are suitable for printing or imaging applications. The resistivity of conductor-filled composites, including carbon nanotube composites, is very sensitive to the details of the dispersion process. To date, the most reproducible layer fabrications are based on solution coating (e.g. PR charge transport layer (CTL) coatings). For at least these reasons, carbon nanotube composites have not been looked to for use in imaging or printing applications.

Accordingly, the present disclosure contemplates methods that enable the use of carbon nanotubes in imaging or printing applications, particularly in the coatings and materials of certain pressure components. In accordance with the present disclosure, solublized carbon nanotubes are used as the filler material for the composite outer layer 27 for a pressure roller (such as in a direct-to-paper machine) or transfix roller (such as in an offset printing machine as depicted in, FIG. 2). The solubilized nanotubes may be preferably prepared according to a process described in Chen et al. (J. Chen et al., Journal of American Chemical Society, 124, 9034-9035 (2002) by wrapping the nanotube with an aromatic polymer in a chloroform bath or an appropriate solvent system. One suitable aromatic polymer is a poly(aryleneethynylene). Through π-π interactions, the aromatic polymer chains interact with the carbon nanotubes to debundle and exfoliate the nanotubes. This process thus enables the resulting solublized carbon nanotubes to form good dispersion in a solvent as well as in a base polymer.

In a preferred embodiment, the base polymer is a poly (ester-urethane). The base polymer may be a two-component polymer including isocyanate and polyesterpolyol. These components may be combined with the solublized carbon nanotubes to form the desired composite material. The solublized carbon nanotubes are provided at a low concentration, preferably less than 10% by weight. It has been found that nanotube concentrations as low as 2% by weight introduce sufficient conductivity properties to eliminate ghosting for many printing applications, without sacrificing the strength and durability of the roller surface formed by the composite.

Figure 5:
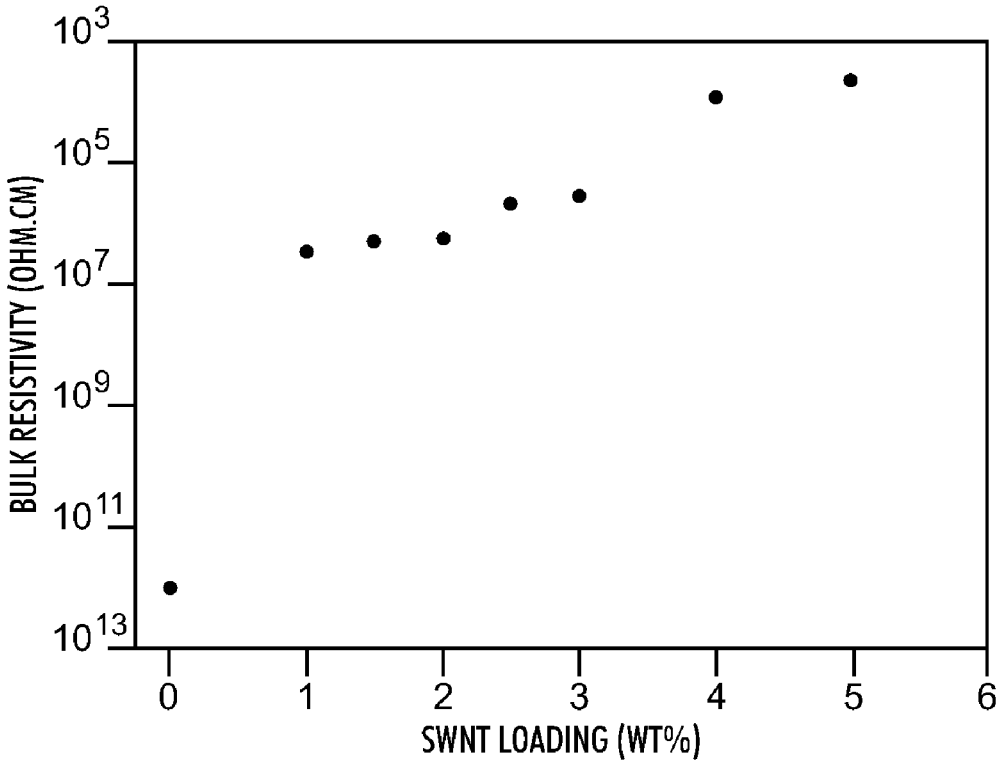
FIG. 5 is a graph showing the resistivity as a function of the weight percent of solublized carbon nanotubes in a substrate according to the present disclosure.

The resistivity (which is the reciprocal of conductivity) of the resulting polymer composite may be adjusted by changing the weight concentration of the solublized carbon nanotubes. In one example, illustrated graphically in FIG. 5, the bulk (or volume) resistivity of a poly(ester-urethane) base having a very high resistivity (i.e., negligible conductivity) in the range of $10^{13}$ ohm-cm can be decreased by more than twofold to about $10^6$ ohm-cm with a nanotube concentration of 1% by weight. At 5% by weight, the resistivity is decreased further to about $10^4$ ohm-cm. The resistivity appropriate for a particular transfix roller may be determined empirically or by experimentation. However, it is contemplated that a resistivity in the range of $10^2$ to $10^4$ ohm-cm will be appropriate for most pressure or transfix rollers. As shown in the graph of FIG. 5 this resistivity range translates to a CNT weight percentage of about 4-6%.

The resulting composite layer may be applied to the roller substrate according to conventional techniques. For instance, the polymer-nanotube composite may be applied using dipping, spraying, flow-coating or injection molding. The presence of the solublized carbon nanotubes does not diminish the ability to apply the composite material as a thin film over the roller substrate.

It can be appreciated that the present disclosure provides a surface layer for a transfix pressure roller that is strong enough to endure the high nip pressures for many high speed applications, while permitting tailored conductivity/resistivity. This controlled conductivity allows the surface of the transfix roller to quickly and efficiently dissipate surface charges generated during the printing process. The present disclosure also provides a method for effectively combining carbon nanotubes with a polymer filler by overcoming the properties of such nanotubes that inherently prevent uniform dispersion, embodied in the solublized carbon nanotubes described above.

In the preferred embodiment, the outer layer of a single or multiple layer transfix roller is composed of the polymer/solublized carbon nanotube composite disclosed herein. The outer layer is preferably provided in a thickness of from about 20 microns to about 3 mm. In a multiple layer transfix roller, the base and intermediate layers may also be formed of the disclosed polymer/solublized carbon nanotube composite. The conductivity of the intermediate and base layers need not be as great as the conductivity of the outer layer, which translates to a lower weight percentage of solublized carbon nanotube in the layer composite. In a specific example, the outer layer of a multiple layer transfix roller may have a bulk resistivity of about $10^4$ ohm-cm and a nanotube concentration of about 4%, as reflected in the graph of FIG. 5. An intermediate layer may then have a bulk resistivity of about $10^6$ ohm-cm and a solublized carbon nanotube concentration of about 1% by weight.

Figure 6:
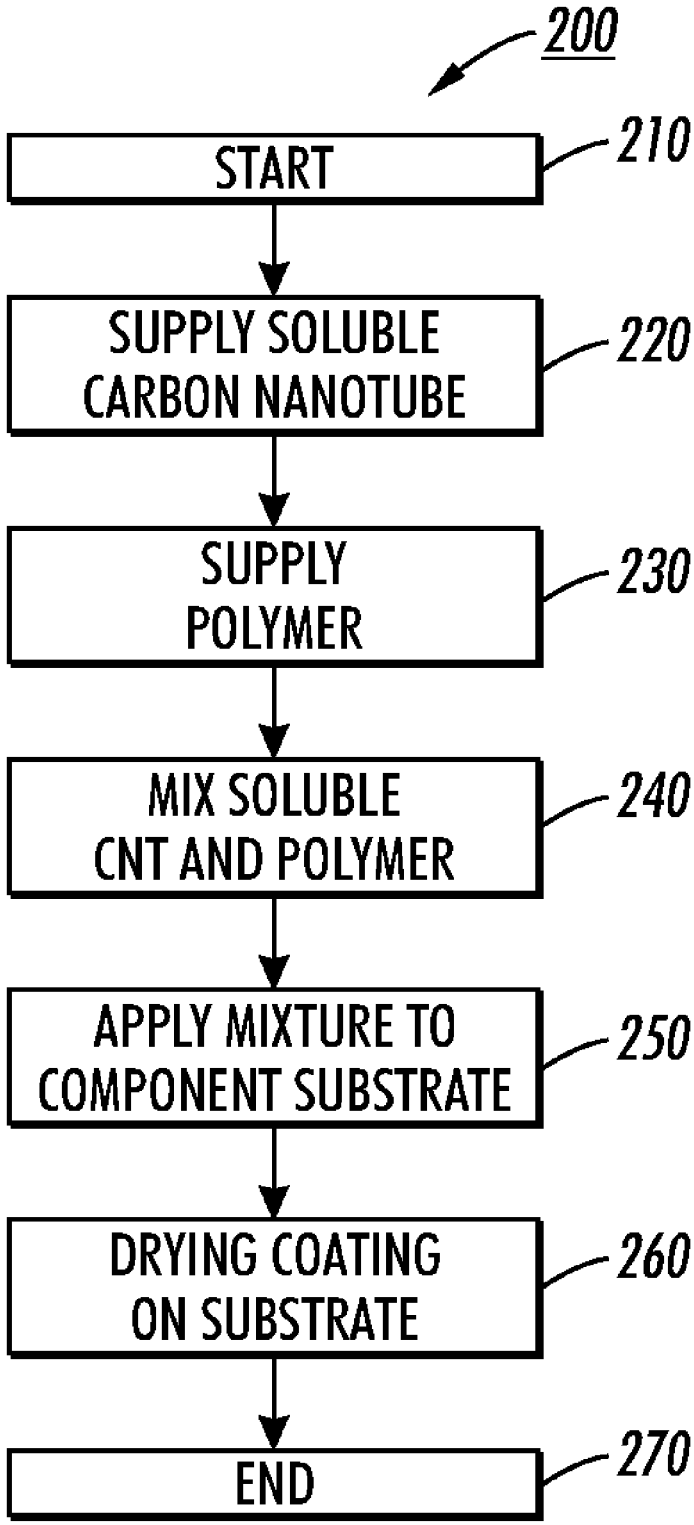
FIG. 6 is a process flowchart in accordance with an exemplary embodiment.

The above described embodiments pertain generally to solutions for obtaining electrically resistive coatings or layers in components of imaging or printing machines. More specifically, the solutions can be applicable to obtaining soluble CNT/polymer coatings of a predetermined resistivity range. Soluble CNT can result in more uniform distribution of CNT in a polymer or other bulk material, thereby improving processing latitude. Thus, in one process 200 described in FIG. 6, and starting at 210, an amount of soluble carbon nanotube complex is provided at 220 and an amount of polymer is supplied at 230. The soluble carbon nanotube complex is mixed, blended, or otherwise combined with the polymer at 240 to form a coating solution or dispersion or a usable composite. Typically, the coating material will be in a liquid or viscous form, suitable for application to a substrate. The coating material is applied to the substrate at 250, followed by curing, drying 260 or other suitable treatment for binding the coated layer to the selected substrate. The process ends at 270 and the thus coated component is ready for use in an electrophotographic imaging device.

The carbon nanotubes can be any of single wall carbon nanotube, double wall carbon nanotube, multiwall carbon nanotube, or a mixture thereof. Length, diameter, and chirality can vary according to processing methods, duration and temperature of the synthesis. Likewise, purity can vary according to processing parameters.

It will be further appreciated that the soluble CNT/polymer composite can be provided on the substrate in a pattern, or as a uniform coating according to an end application of the imaging device component.

The coating can be applied using any conventional technique, e.g. dip, spin, spray, draw-down, flow-coat, extrusion, etc. The soluble CNT complex can be combined with a polymer, either as a mixture in predetermined proportions or by other suitable methods. In one example of a coating material, multiwall carbon nanotube is mixed with a polycarbonate. Drying or curing of the coated layer can be, for example, less than about 150° C. A coating thickness can be in the range of about 3 to about 50 microns.

Exemplary polymers for combination with the soluble CNT complex can include nylons and other acrylic resins. Use of a low surface energy polymer can reduce surface contamination, and therefore partially fluorinated polymeric materials can also be used. Other exemplary polymers can include polycarbonates, polyesters (PMMA), polyacryclates, polvinylchlorides, polystyrenes, polyurethanes, etc.

Figure 7:
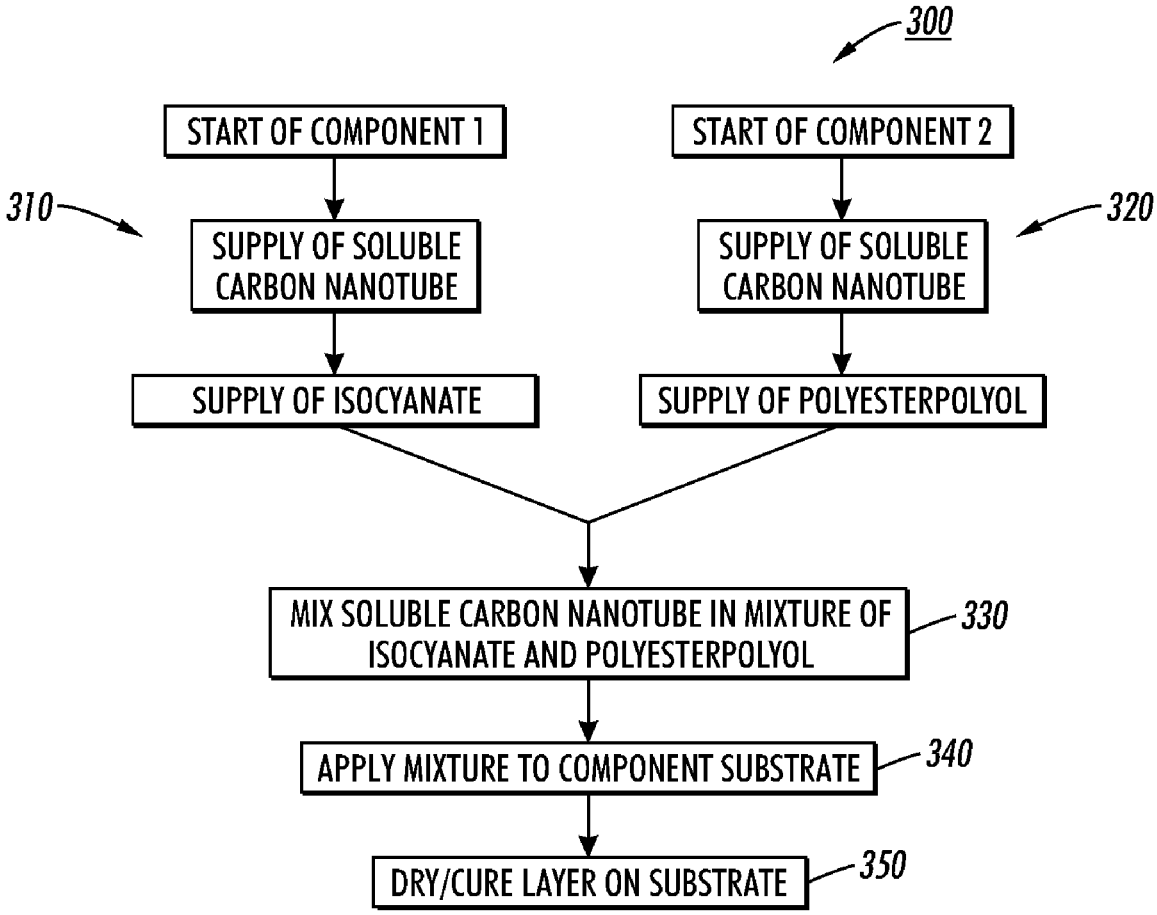
FIG. 7 is a process flowchart for a two-component exemplary embodiment.

An alternative process 300 is depicted in FIG. 7 which implements a two-component process. The first component is represented by the process branch 310, while the second component is described in branch 320. In the first branch 310, a supply of soluble CNT, as described above, and a supply of isocyanate are mixed. In the second branch 320, a supply of a similar soluble CNT and a supply of polyesterpolyol are mixed. The two components are then mixed in step 330 according to known techniques. The resulting composite mixture is applied as a layer or substrate to the pressure or transfix roller in step 340 and cured in step 350, in the manner described above.

Although the relationships of components are described in general terms, it will be appreciated that one of skill in the art can add, remove, or modify certain components without departing from the scope of the exemplary embodiments.

Other embodiments will be apparent to those skilled in the art from consideration of the specification and embodiments disclosed herein. It is intended that the specification and examples be considered as exemplary only, with a true scope and spirit of the invention being indicated by the following claims and their equivalents.

It can be appreciated that the transfix rollers described herein incorporate sufficient electrical conductivity to disperse electrical charges associated with the substrate, particularly in a duplex mode of operation. The resulting roller thus substantially eliminates any image ghosting during this duplex operation. The composite layer of a polymer and solubilized CNTs provides the requisite conductivity without sacrificing strength and without compromising the ability of the roller to withstand the typical pressures in standard or high-speed applications.

While the above disclosure specifically addresses a transfix roller, the same CNT composite layer may applied to a pressure roller in a direct-to-paper imaging process. In this type of process, no imaging drum is utilized but rather a pair of opposing pressure rollers that compress a solid ink jet image applied directly to the moving substrate. The composite layer disclosed above may be incorporated into a least one pressure roller, with the resistivity calibrated to provide optimum conductivity for charge dissipation, as described above. The pressure roller may be provided in single or multiple layer embodiments, as described herein.

It is further contemplated that graphenes may be integrated into one or more layers of a pressure or transfix roller in substantially the same manner as the CNTs described herein, either in lieu of or in combination with the CNTs. The graphenes may exhibit different conductivity characteristics from the CNTs but the graphene concentration may be calibrated in the same manner as the CNTs to achieve the desired conductivity.

In another alternative, the CNTs may not be solubilized when combined with the polymeric material forming the roller layer(s). In some embodiments, adequate dispersion of the CNTs may be achieved mechanically as the CNTs are combined directly with the layer polymer.

What is claimed is:

1. A printing machine for transferring a phase change ink onto a print medium comprising:

a) a phase change ink component configured to apply a phase change ink to form a phase change ink image;

b) an imaging member having a surface on which the phase change ink image is formed by the phase change ink component, the imaging member being configured to transfer the phase change ink image from the surface of the imaging member to a print medium; and c) a pressure member positioned proximate the imaging member and configured to selectively engage the imaging member to form a nip in which pressure is exerted to transfer and fuse the phase change ink image onto the print medium as the print medium passes through the nip, the pressure member having an outer layer that includes an electrically conductive composite of a polymer and at least one of carbon nanotubes and graphenes.

2. The printing machine of claim 1, wherein said composite includes between about 1% to about 10% by weight carbon nanotubes.

3. The printing machine of claim 1, said pressure member further comprising:

an intermediate layer that includes said electrically conductive composite of a polymer and at least one of carbon nanotubes and graphenes.

4. The printing machine of claim 3, wherein the composite forming said intermediate layer has a lesser weight percent of carbon nanotubes or graphenes than the composite of said outer layer.

5. The printing machine of claim 1, wherein said polymer is a poly(ester-urethane).

6. The printing machine of claim 1, wherein the carbon nanotubes are solubilized.

7. A printing machine for transferring a phase change ink onto a print medium comprising:

a) a phase change ink component configured to apply phase change ink to form a phase change ink image;

b) an imaging member having a surface on which the phase change ink image is formed by the phase change ink component, the imaging member being configured to transfer the phase change ink image from the surface of the imaging member to a print medium; and c) a pressure member positioned proximate the imaging member and configured to selectively engage the imaging member to form a nip in which pressure is exerted to transfer and fuse the phase change ink image onto the print medium as the print medium passes through the nip, the pressure member having an electrically conductive outer polymer layer having resistivity in a range of 1 to $10^6$ ohm-cm along a length of the pressure member.

8. The printing machine of claim 7, wherein said pressure member includes a substrate and a single outer conductive layer having a modulus of between 8-300 MPa and a thickness of between 0.3-10 mm.

9. The printing machine of claim 7, wherein said transfix pressure member includes a substrate, an intermediate polymer layer and an outer conductive layer having modulus of between 1-50 MPa and a thickness of between 0.1-2.0 mm.

* * * * *